US007578238B1

(12) United States Patent
Dabiri

(10) Patent No.: US 7,578,238 B1
(45) Date of Patent: Aug. 25, 2009

(54) BASE BLEED BOAT TAIL CONVERTER FOR PROJECTILE

(75) Inventor: Shahram Dabiri, Flanders, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 645 days.

(21) Appl. No.: 11/306,835

(22) Filed: Jan. 12, 2006

(51) Int. Cl.
*F42B 12/20* (2006.01)

(52) U.S. Cl. ..... 102/490; 102/381; 102/374; 102/481; 102/380

(58) Field of Classification Search ..... 102/381, 102/374, 490, 481, 380
See application file for complete search history.

(56) References Cited

U.S. PATENT DOCUMENTS 3,204,559 A * 9/1965 De Matthew ..... 102/202
4,370,930 A * 2/1983 Strasser et al. ..... 102/530
4,807,532 A * 2/1989 Andersson et al. ..... 102/490
4,846,071 A * 7/1989 Franzen et al. ..... 102/490
5,155,298 A * 10/1992 Koontz ..... 102/481
5,886,289 A * 3/1999 Nixon et al. ..... 102/490
6,213,023 B1 * 4/2001 Gunners ..... 102/490
7,360,355 B1 * 4/2008 Gadiot ..... 60/255

* cited by examiner

*Primary Examiner*—Michael J. Carone
*Assistant Examiner*—Samir Abdosh
(74) *Attorney, Agent, or Firm*—Michael C. Sachs

(57) ABSTRACT

A projectile may be used in a boat tail or base bleed configuration. The projectile includes a warhead casing having a nose end and a base end; a payload disposed in the warhead casing; a motor body attached to the base end of the warhead casing and having an igniter disposed therein; a base closure attached to the motor body, an exterior surface of the base closure being tapered to form a boat tail, the base closure and the motor body defining an interior volume; a propellant disposed in the interior volume, the propellant being used for base bleed operation; and a converter attached to the base closure and extending into the interior volume.

6 Claims, 4 Drawing Sheets

BASE BLEED BOAT TAIL CONVERTER FOR PROJECTILE

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to tube launched projectiles.

The rear or base end of projectiles are usually either flat or tapered. FIG. 1A shows a projectile 10 with an obturator or rotating band 16 and a flat base 12. FIG. 1B shows a projectile 14 with a rotating band 18 and a tapered base 20. The tapered base 20 is known as a boat tail. Boat tails, in a mechanical way, help reduce the aerodynamic drag at the base. A base bleed is another way to reduce base drag. Both boat tails and base bleeds are known.

A base bleed is a gas generator that operates similar to a rocket motor. The base bleed fills the aerodynamic void created behind the projectile with combustion gases, thereby reducing the base drag. The combustion gases of the base bleed produce, in effect, a very long boat tail. By reducing the base drag, the base bleed allows the projectile to fly further. For long distances, then, the base bleed is preferred.

However, when firing a projectile at a low angle and a low speed (i.e., short distances), the projectile needs base drag to fly correctly and to prevent it from tumbling out of control. A base bleed projectile requires a high elevation of the firing barrel with respect to the horizon. Thus, if one has a base bleed projectile, which has very low base drag, one cannot fire it at a low angle and a low speed. One can fire a boat tail projectile at a low angle and a low speed. Even though a boat tail has reduced drag compared to a flat base, the drag is sufficient to keep the projectile stable. The boat tail is preferred for short distances and the base bleed is preferred for long distances. To prepare for both short and long distances, one needs to have two sets of projectiles, boat tail projectiles for short distances and base bleed projectiles for long distances. Providing two sets of projectiles is costly.

The known Denel system can change the aerodynamic characteristics of a projectile in the field. The Denel system, however, requires a complete exchange of the base component of the projectile. This entails swapping a base bleed unit for a boat tail unit. The Denel system is inadequate because it requires a complete exchange of the base component either at the gun site or in the front lines. This type of complete exchange requires proper lighting as well as specialized equipment to properly clean and seat the components, to assure proper operation and gun safety.

SUMMARY OF THE INVENTION

It is an object of the invention to provide an apparatus for converting a boat tail projectile to a base bleed projectile and vice versa.

It is another object of the invention to provide a projectile that is convertible from base bleed to boat tail and vice versa.

A further object of the invention is to provide a projectile that may be converted from base bleed to boat tail without any tools.

One aspect of the invention is a projectile comprising a warhead casing having a nose end and a base end; a payload disposed in the warhead casing; a motor body attached to the base end of the warhead casing and having an igniter disposed therein; a base closure attached to the motor body, an exterior surface of the base closure being tapered to form a boat tail, the base closure and the motor body defining an interior volume; a propellant disposed in the interior volume, the propellant being used for base bleed operation; and a converter attached to the base closure and extending into the interior volume.

The converter comprises a first cylindrical portion that is hollow; a generally conical portion that is hollow and connected to the first cylindrical portion; a second cylindrical portion that is hollow and connected to the generally conical portion; a plate disposed between the first cylindrical portion and the generally conical portion; and a flange disposed around a base of the second cylindrical portion. Preferably, the flange includes a groove formed therein and a seal disposed in the groove.

The converter may further comprise a pair of handles attached to the flange. In one embodiment, the converter further comprises a pair of locking tabs disposed on an external surface of the converter and the base closure comprises a corresponding pair of grooves for insertion of the locking tabs. The second cylindrical portion of the converter may include external threads and an opening in the base closure may include corresponding internal threads.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1A:
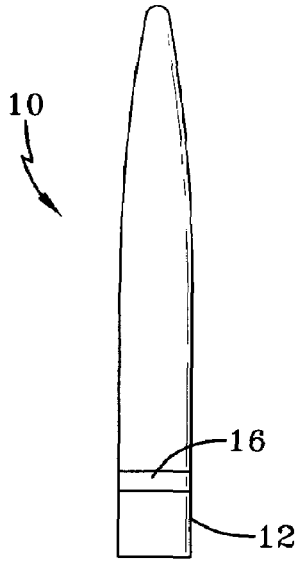
FIG-1A PRIOR ART
FIG. 1A shows a flat base projectile.
Figure 1B:
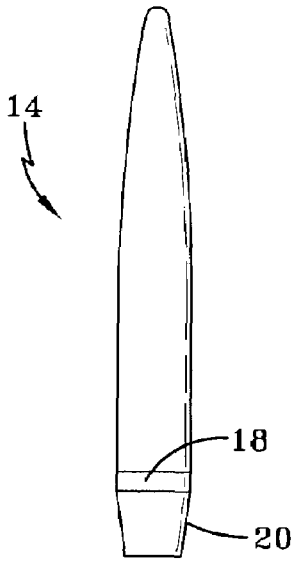
FIG-1B PRIOR ART
FIG. 1B shows a boat tail projectile.
Figure 2:
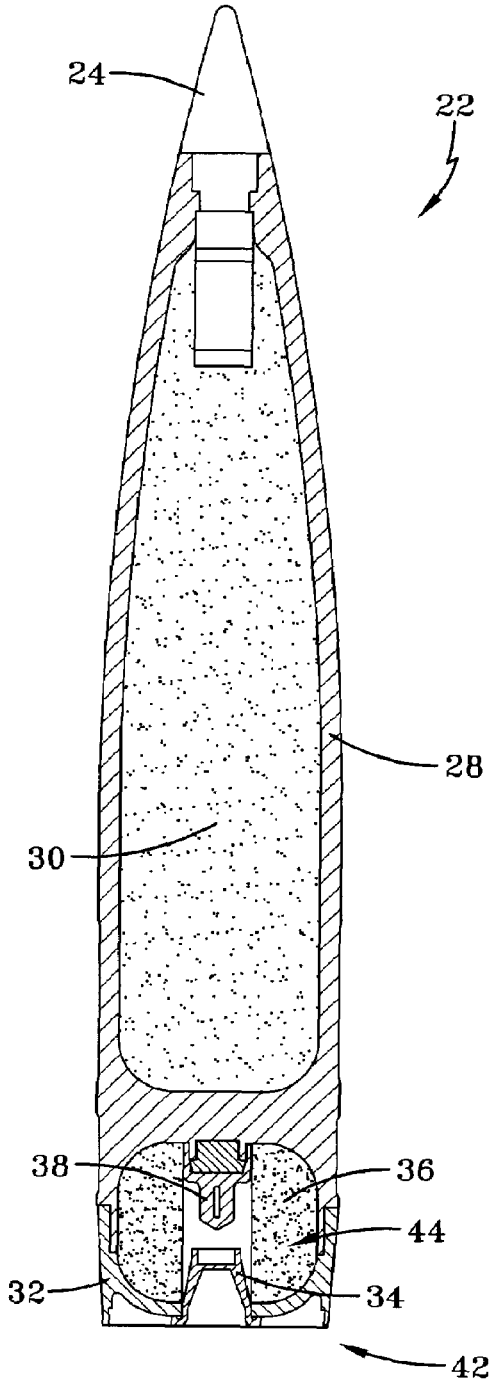
FIG. 2 is a cutaway side view of one embodiment of a projectile according to the invention.

The present invention allows the user to convert a base bleed projectile into a boat tail projectile in the field or vice versa. FIG. 2 is a cutaway side view one embodiment of a projectile 22 according to the invention.

Projectile 22 comprises a warhead casing 28 having a nose end 24 and a base end 42. A payload 30 is disposed in the warhead casing 28. Payload 30 may be, for example, a high-energy explosive fill or a plurality of submunitions. A motor body 40 is attached to the base end 42 of the warhead casing 28. The motor body 40 has an igniter 38 disposed therein. A base closure 32 is attached to the motor body 40. The exterior surface of the base closure 32 is tapered to form a boat tail. The base closure 32 and the motor body 40 define an interior volume 44 in which is disposed a base bleed propellant 36. A converter 34 is attached to the base closure 32 and extends into the interior volume 44.

Figure 3:
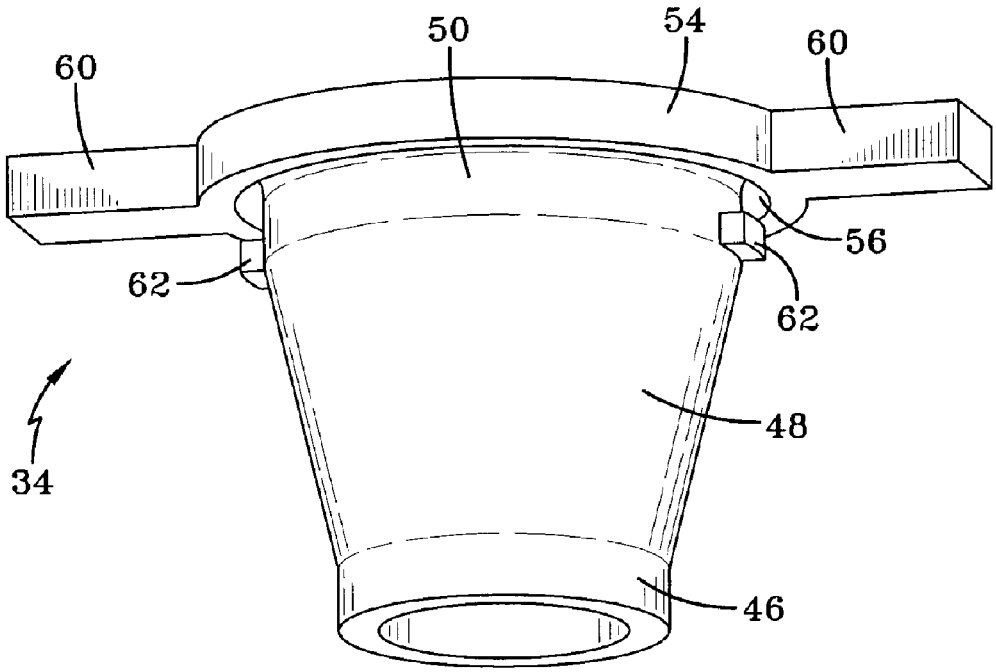
FIG. 3 is a perspective view of a converter.
Figure 4:
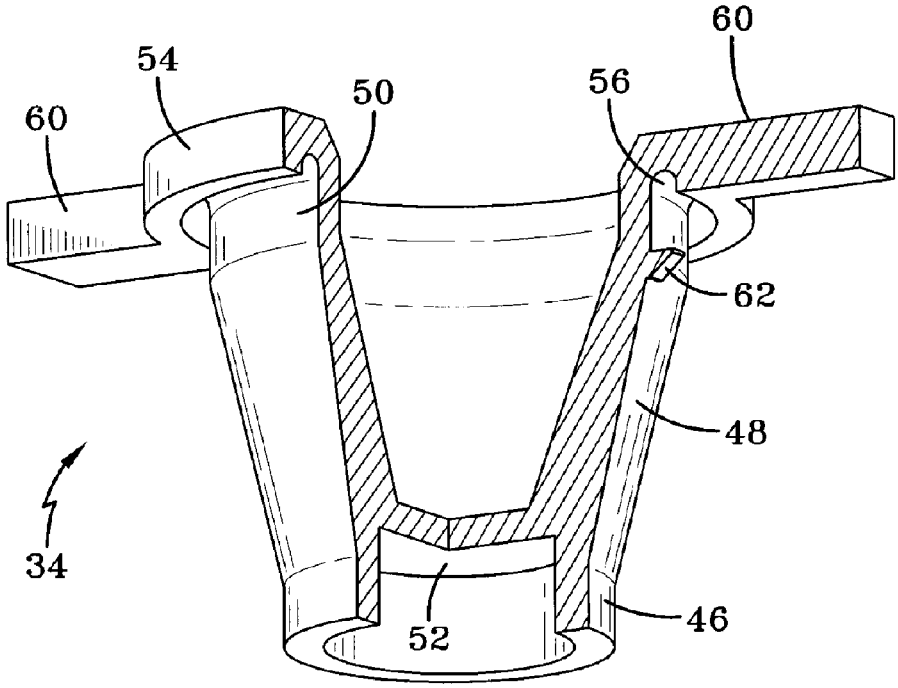
FIG. 4 is a cutaway perspective view of a converter.

FIG. 3 is a perspective view of one embodiment of a converter 34 and FIG. 4 is a cutaway perspective view of the converter 34. The converter 34 comprises a first cylindrical portion 46 that is hollow; a generally conical portion 48 that is hollow and connected to the first cylindrical portion 46; a second cylindrical portion 50 that is hollow and connected to the generally conical portion 48; a plate 52 (FIG. 4) disposed between the first cylindrical portion 46 and the generally conical portion 48; and a flange 54 disposed around the base of the second cylindrical portion 50. Converter 34 may be made of steel, for example, and may be machined or forged.

Figure 5:
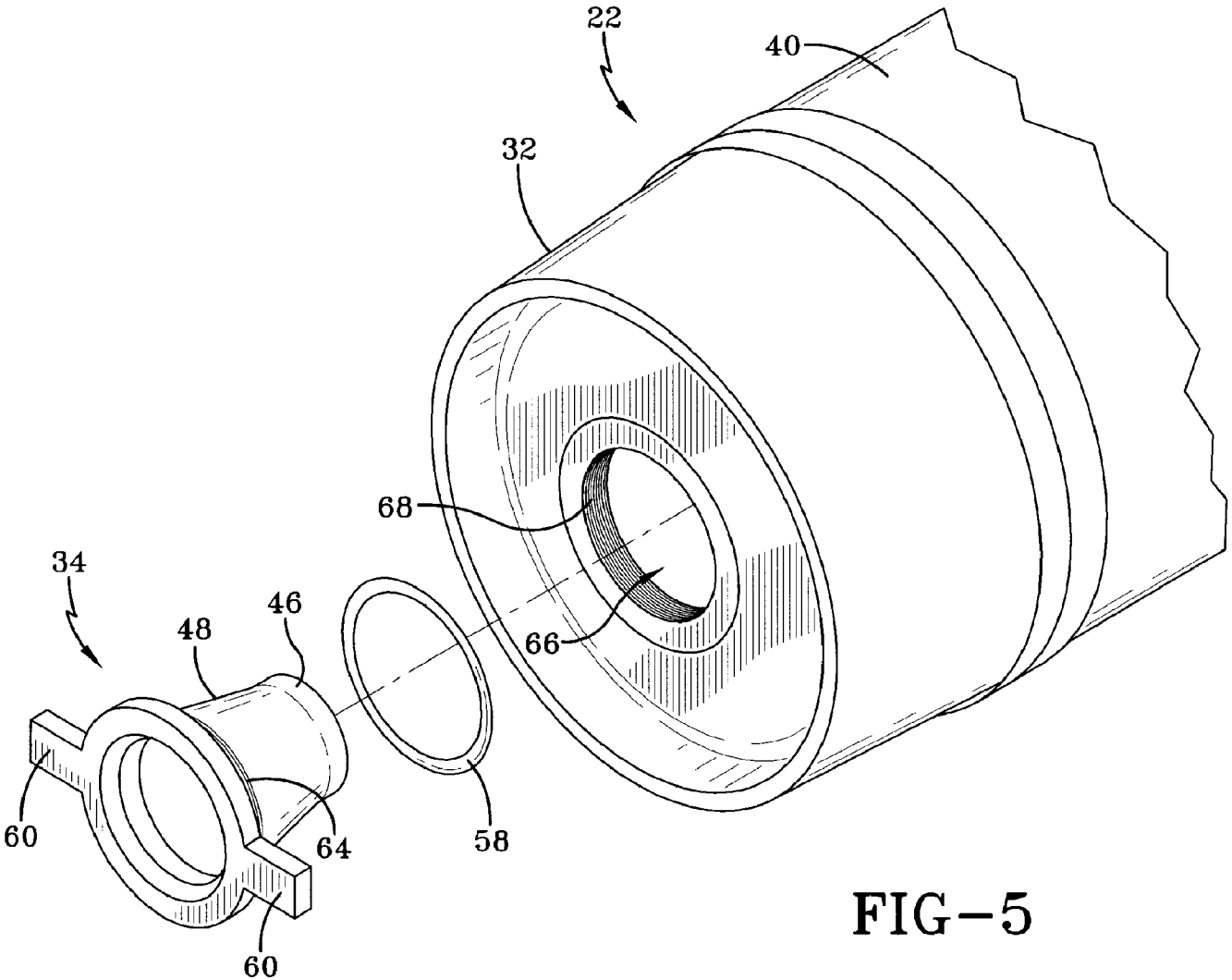
FIG. 5 is an exploded view of the base of a projectile.

The flange 54 includes a groove 56 formed therein and a seal disposed in the groove 56. The seal is preferably an O-ring 58 (FIG. 5). The O-ring 58 bears against the rear surface of the base closure 32 around opening 66 and seals the base closure 32 from the environment. A pair of handles 60 are attached to the flange 54, preferably on opposite sides. The handles 60 are used to insert or remove the converter 34 from the base closure 32.

In FIG. 2, for purposes of clarity, a space is shown between the first cylindrical portion 46 and the igniter 38. Preferably, at least a portion of the igniter 38 is disposed inside the first cylindrical portion 46 of the converter 34.

The converter 34 may be attached to the base closure 32 in a variety of ways. FIG. 5 is an exploded view of the base of a projectile 22 showing a converter 34 with external threads 64 on its second cylindrical portion 50. The external threads 64 engage internal threads 68 formed at the opening 66 in the base closure. To insert or remove the converter 34, one grasps the handles 60 and rotates the converter 34 into or out of the base closure 32. The bottom of the device rests against the top of the igniter housing.

Figure 6:
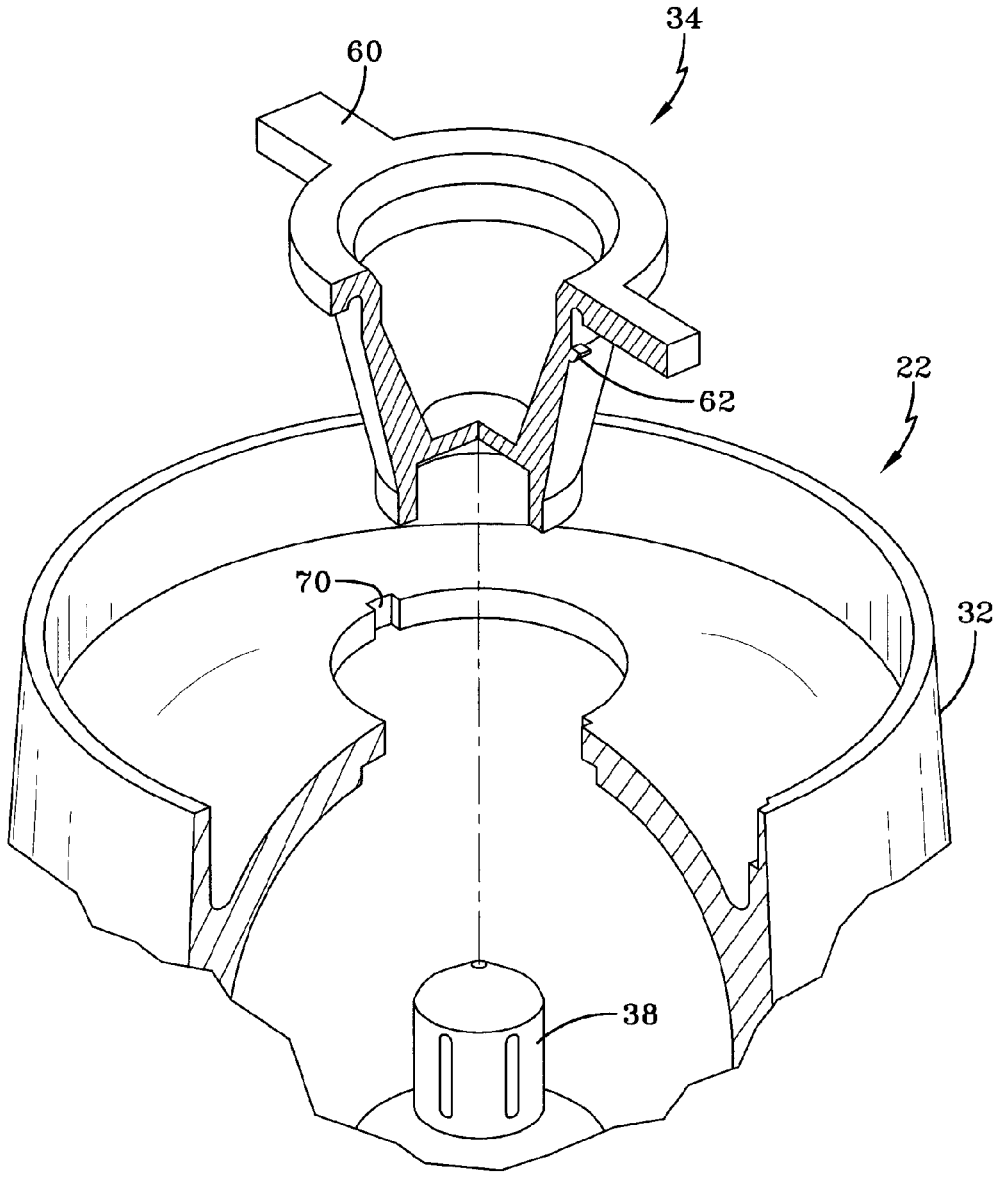
FIG. 6 is an exploded, cutaway view of the base of a projectile.

Another way to attach the converter 34 to the base closure 32 uses a pair of tabs 62 (FIG. 4) formed on the exterior of the converter where the second cylindrical portion 50 joins the conical portion 48. The pair of tabs 62 are preferably 180 degrees apart. FIG. 6 is an exploded, cutaway view of the base of a projectile 22 showing a groove 70 formed in the base closure 32. Another groove 70 is formed 180 degrees away (not shown in the cutaway). To insert the converter 34, the two tabs 62 are aligned with the two grooves 70. The converter 34 is pushed into the base closure 32 until it seats with the flange 54 and O-ring 58 bearing against the base closure 32. The converter 34 is then rotated ninety degrees using the handles 60. To remove the converter 34, the steps are reversed. The threads 64, 68 are not used with the tabs 62 and grooves 70.

During manufacture of the projectile 22, the converter 34 is inserted into the base closure 32. In the field, one determines if an extended range projectile is required. If yes, then the converter 34 is removed. Removing the converter 34 exposes the base bleed propellant 36 that has been loaded in the interior volume 44. A separate propelling charge (not shown) is located beneath the projectile 22 in the gun tube. When the separate propelling charge is ignited, it produces high temperature and high-pressure gases that propel the projectile 22 down the gun tube. At the same time, because the converter 34 has been removed, the high temperature and high-pressure gases enter the base closure 32 through opening 66 and ignite the propellant 36. When the projectile 22 exits the gun tube, the gases produced by the propellant 36 fill the aerodynamic void at the rear of the projectile 22 and form an extended gaseous boat tail. The gaseous boat tail reduces base drag on the projectile 22, thereby extending the range of the projectile 22.

If, in the field, if it is determined that an extended range projectile is not needed, then the converter 34 is left in place in the base closure 32. The gases from the separate propelling charge now impinge on the plate 52 and the interior surface of the converter 34, which prevents the propellant 36 from igniting. When the projectile 22 exits the gun tube, the projectile 22 experiences the base drag associated with a conventional boat tail projectile, which can be launched at lower angles and shorter ranges. Thus, the converter 34 allows a single projectile 22 to be used in a conventional boat tail configuration or in a base bleed configuration.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A projectile, comprising: a warhead casing having a nose end and a base end; a payload disposed in the warhead casing; a motor body attached to the base end of the warhead casing and having an igniter disposed therein; a base closure attached to the motor body, an exterior surface of the base closure being tapered to form a boat tail, the base closure and the motor body defining an interior volume; a propellant disposed in the interior volume, the propellant being used for base bleed operation, and a converter attached to the base closure and extending into the interior volume, wherein the converter comprises: a first cylindrical portion that is hollow; a generally conical portion that is hollow and connected to the first cylindrical portion; a second cylindrical portion that is hollow and connected to the generally conical portion; a plate disposed between the first cylindrical portion and the generally conical portion; and a flange disposed around a base of the second cylindrical portion.

2. The projectile of claim 1 wherein the flange includes a groove formed therein and a seal disposed in the groove.

3. The projectile of claim 1 wherein the converter further comprises a pair of handles attached to the flange.

4. The projectile of claim 1 wherein the converter further comprises a pair of locking tabs disposed on an external surface of the converter and the base closure comprises a corresponding pair of grooves for insertion of the locking tabs.

5. The projectile of claim 1 wherein the second cylindrical portion of the converter includes external threads and an opening in the base closure includes corresponding internal threads.

6. The projectile of claim 1 wherein the igniter is partially disposed in the first cylindrical portion of the converter.

* * * * *